US008820424B2

(12) United States Patent
Lozier et al.

(10) Patent No.: US 8,820,424 B2
(45) Date of Patent: Sep. 2, 2014

(54) FIRE FIGHTING NOZZLE

(75) Inventors: Todd Brian Lozier, Elkhart, IN (US); Donald E. Sjolin, Granger, IN (US)

(73) Assignee: Elkhart Brass Manufacturing Company, Inc., Elkhart, IN (US)

( * ) Notice: Subject to any disclaimer, the term of this patent is extended or adjusted under 35 U.S.C. 154(b) by 550 days.

(21) Appl. No.: 12/498,707

(22) Filed: Jul. 7, 2009

(65) Prior Publication Data

US 2010/0032491 A1 Feb. 11, 2010

Related U.S. Application Data

(60) Provisional application No. 61/079,068, filed on Jul. 8, 2008, provisional application No. 61/079,931, filed on Jul. 11, 2008.

(51) Int. Cl.
*A62C 35/58* (2006.01)
*A62C 31/03* (2006.01)

(52) U.S. Cl.
CPC ..... *A62C 31/03* (2013.01)
USPC ..... 169/88; 239/348

(58) Field of Classification Search
CPC ..... A62C 13/00; A62C 17/00; A62C 25/00
USPC ..... 239/438, 439, 443, 461, 504, 505, 519, 239/569, 570, 11; 169/37, 90, 19, 43, 88
See application file for complete search history.

(56) References Cited

U.S. PATENT DOCUMENTS

| | | | | |
|---|---|---|---|---|
| 2,568,429 | A * | 9/1951 | Burnam et al. | 239/452 |
| 3,779,318 | A * | 12/1973 | Livingston | 169/70 |
| 3,863,844 | A | 2/1975 | McMillan | |
| 3,904,125 | A | 9/1975 | Allenbaugh | |
| 5,312,048 | A | 5/1994 | Steingass et al. | |
| 7,048,207 | B2 * | 5/2006 | Crabtree et al. | 239/416.4 |

FOREIGN PATENT DOCUMENTS

WO WO 95/19504 7/1995

OTHER PUBLICATIONS

PCT Search Report mailed Mar. 2, 2010 for the corresponding PCT Application No. PCT/US2009/049782.

* cited by examiner

*Primary Examiner* — Davis Hwu
(74) *Attorney, Agent, or Firm* — Faegre Baker Daniels LLP

(57) ABSTRACT

A fire fighting nozzle includes a nozzle body with an inlet, an outlet, and a passageway extending from the inlet to the outlet. A stem is located in the passageway about which fluid flows when fluid is flowing through the passageway. And, a projecting body projects outwardly from the nozzle body away from the stem, which at least partially fills the space beyond the nozzle outlet where water exits the nozzle assembly.

26 Claims, 8 Drawing Sheets

FIRE FIGHTING NOZZLE

This application claims the benefit of provisional applications each entitled FIRE FIGHTING NOZZLE, U.S. applications Ser. Nos. 61/079,068 and 61/079,931 filed on Jul. 8, 2008 and Jul. 11, 2008, respectively, which are herein incorporated by reference in their entireties.

TECHNICAL FIELD AND BACKGROUND OF THE INVENTION

The present invention relates to a nozzle and, more particularly, to a fire fighting nozzle.

Typical combination fire fighting nozzles (nozzles that produce a stream that can be transitioned from a protective fog pattern to a straight stream pattern) use a stem that has a small diameter shaft attached to a larger diameter stem head. The stem head is positioned internal to the tubular tip of the nozzle such that the difference between the outside (OD) of the stem head and the inside diameter (ID) of the tip create an orifice which appropriately meters the water flow for the desired flow/pressure operational characteristics. Due to the fact that the stem heads are relatively large, the void area just beyond the nozzle orifice where the water exits the nozzle creates a natural vacuum. This vacuum helps to bring the stream together and create the "straight stream" pattern. However, this vacuum creates a negative pressure which acts against the desired directional flow of the water—the direction consistent with the effective reach of the stream.

SUMMARY OF THE INVENTION

Accordingly, the present invention provides a nozzle assembly that fills this void area thereby lessening the affect of the vacuum. The nozzle assembly may also provide a flow surface where the natural surface tension of water can be harnessed to converge the water stream in a less aggressive manner than heretofore known. Together, these two effects can create a less disrupted stream, a better stream reach, and an improved water delivery footprint at the target.

In one form of the invention, a nozzle assembly includes a nozzle body with an inlet, an outlet, and a passageway extending from the inlet to the outlet. The nozzle assembly further includes a stem located in the passageway about which fluid flows when fluid is flowing through the passageway. Further, an extended body is provided that projects outwardly from the nozzle body and outwardly from the nozzle body outlet, which at least partially fills the void beyond the nozzle outlet where water exits the nozzle assembly.

In one aspect, the extended body has a concave or convex outer flow surface.

In another aspect, the extended body comprises a hollowed extended body. In a further aspect, the hollowed extended body is formed from a pliable material wherein the shape of the outer surface of the extended body may be adjusted and further adjusted in a manner to provide an abutment against which the water exiting the nozzle body outlet impinges.

According to yet a further aspect, a movable member is provided in the flexible hollowed body of the extended body, which may be used to adjust the cross-section of the flexible hollowed body. For example, the movable member may comprise a rod that couples to an actuator on one end and coupled to the flexible hollowed body on the other end. The actuator is then used to move the rod to compress or extend the flexible hollowed body to thereby change the cross-section of the flexible hollowed body.

According to another aspect, the nozzle stem is movably mounted in the passageway to thereby vary the opening size at the outlet of the nozzle body.

According to yet another aspect, the nozzle may comprise a combination nozzle or a smooth bore or solid stream nozzle.

According to yet another aspect, the nozzle may comprise a handline nozzle, a master stream nozzle, a fixed orifice nozzle, or an automatic nozzle.

In yet other aspects, the surface of the extended body may be smooth and further have a varying cross-section along the length of the extended body to thereby form a concave straight or convex or combination of geometric surfaces.

These and other objects, advantages, purposes, and features of the invention will become more apparent from the study of the following description taken in conjunction with the drawings.

DETAILED DESCRIPTION OF THE PREFERRED EMBODIMENTS

Figure 1:
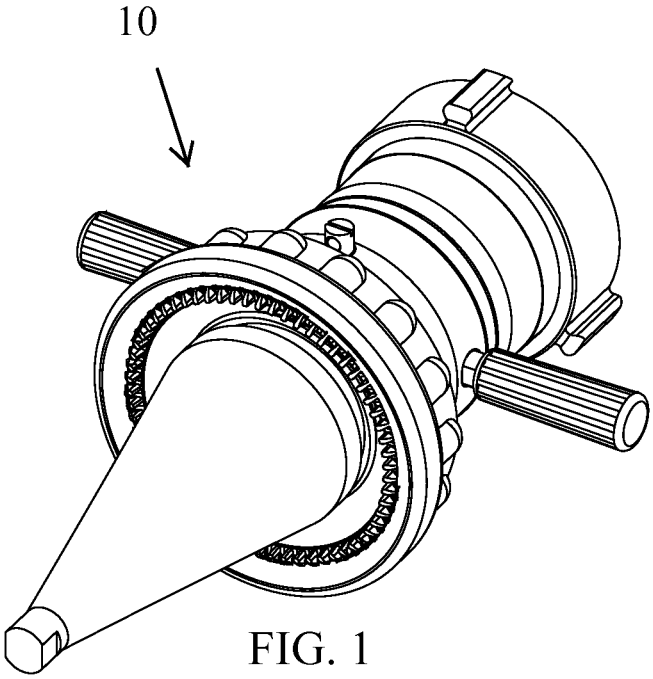
FIG. 1 is a perspective view of a nozzle assembly incorporating the nozzle stem extension of the present invention.
Figure 2:
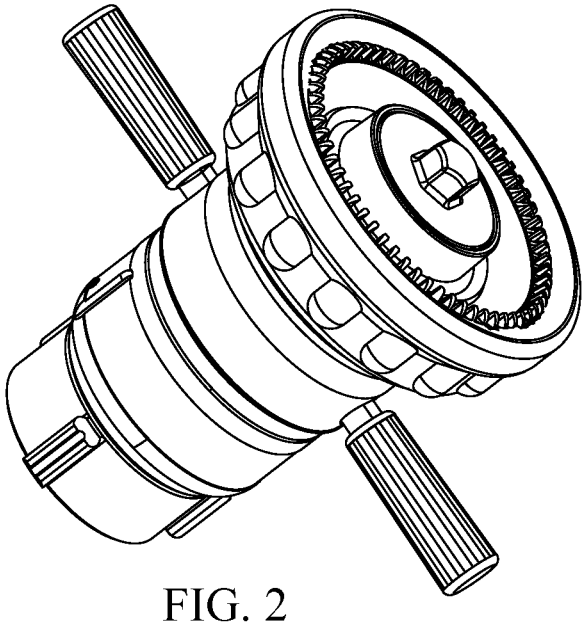
FIG. 2 is a similar perspective view of the nozzle assembly of FIG. 1 with the nozzle extension removed.

Referring to FIG. 1, the numeral 10 generally designates a nozzle assembly of the present invention. As will be more fully described below, nozzle assembly 10 incorporates a nozzle extension 32 to reduce the void area beyond the nozzle outlet where water exits to thereby reduce the vacuum that is generated at the nozzle outlet of conventional nozzles. Further, as will be more fully described below, the nozzle assembly may also provide a flow surface where the natural surface tension of the water may be harnessed to converge the water stream in a less aggressive manner than heretofore known. Although the present invention is described in reference to an adjustable nozzle assembly, it should be understood that the present may be incorporated into a combination nozzle, as well as a smooth bore or solid stream nozzle, including an adjustable solid bore nozzle. Further, the nozzle assembly may comprise a handline nozzle, a master stream nozzle, a variable orifice nozzle, an automatic nozzle, or the like and where applicable may be actuated using a variety of different actuation methods, including manual, electric, hydraulic, or radio frequency controlled or the like.

Figure 3:
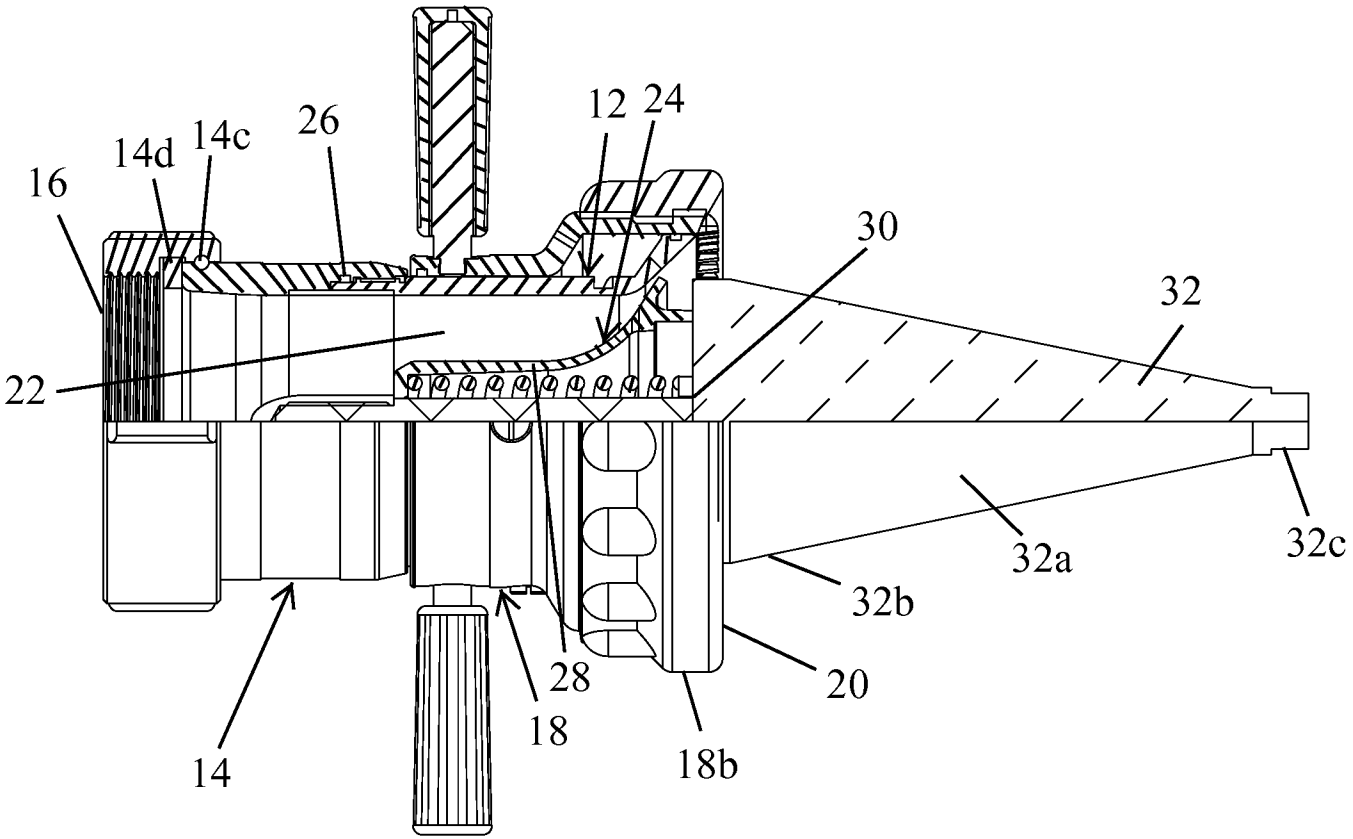
FIG. 3 is a cross-section view of the nozzle assembly of FIG. 1.
Figure 4:
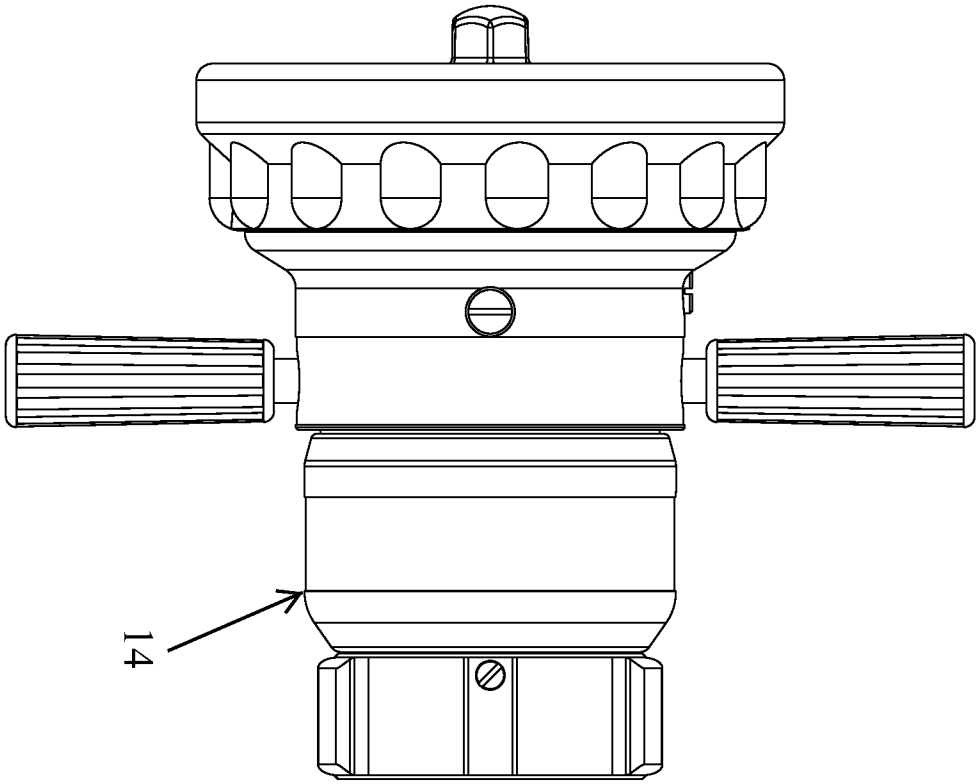
FIG. 4 is a side elevation view of the nozzle assembly with the extension removed.
Figure 4A:
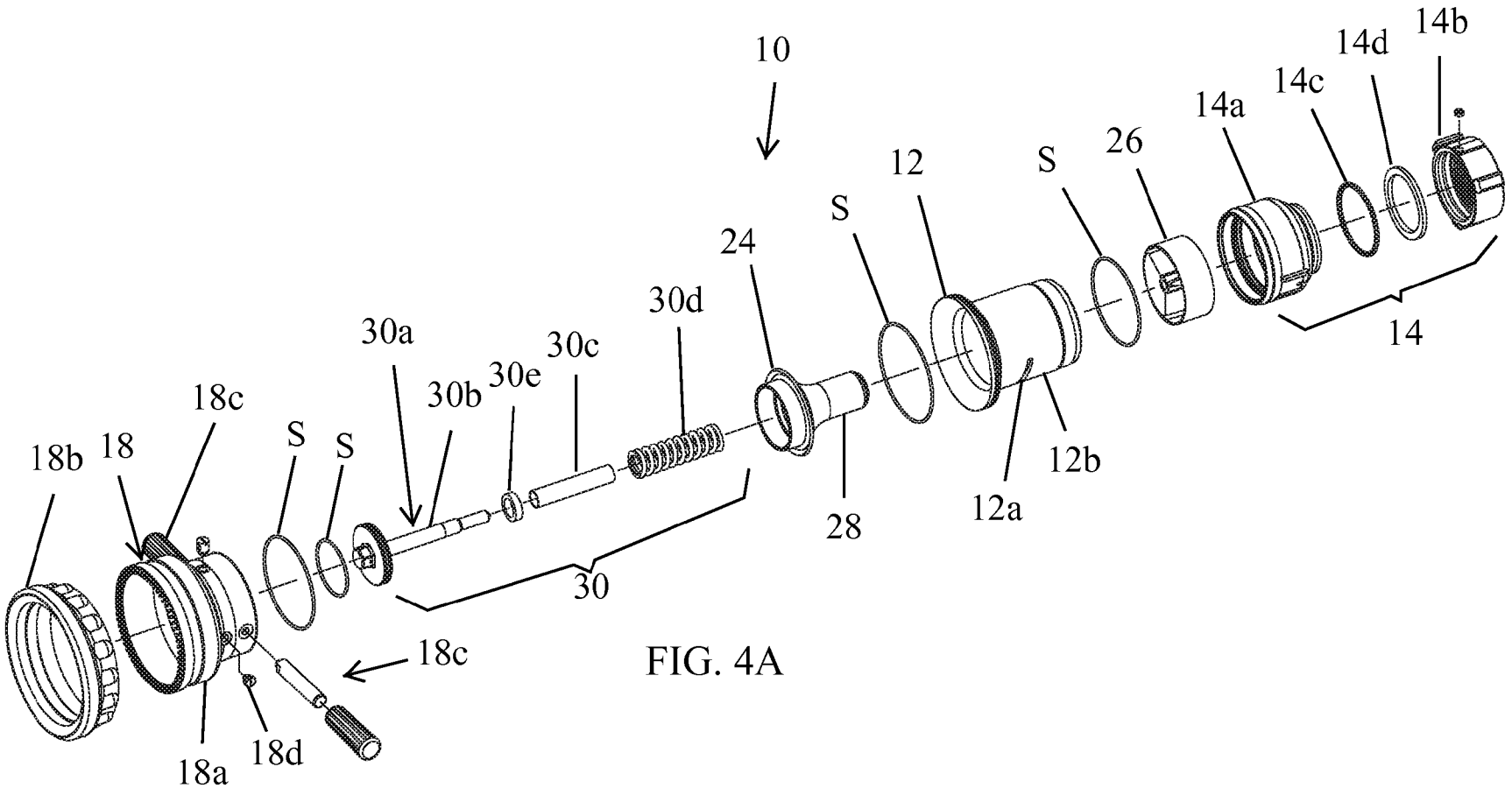
FIG. 4A is an exploded perspective view of the nozzle assembly of FIG. 4.

As best seen in FIGS. 3 and 4A, nozzle assembly 10 includes a nozzle body 12, an inlet assembly 14, which forms an inlet 16, and a nozzle tip 18, which forms an outlet 20. Inlet assembly 14 includes an annular member 14*a* that forms an adapter, which mounts to nozzle body 12, and another annular member 14*b* that is mounted about annular member 14*a* by a low friction connection 14*c*, such as a plurality of ball bearings or TEFLON strip or the like, and forms a swivel connection for connecting a hose to the nozzle assembly, as would be understood by those skilled in the art. To seal this connection, a gasket 14*d*, such as a rubber gasket, is provided between annular member 14*a* and annular member 14*b*.

Nozzle tip 18 includes an annular member 18*a*, which mounts to the opposed end of nozzle body 12, and a bumper 18*b*, which is mounted to annular member 18*a*. Annular member 18*a* supports a pair of handles 18*c* and a drive screw 18*d*, which extends into a groove 12*a* formed on cylindrical body 12*b* of nozzle body 12 so that nozzle tip may be rotated about nozzle body 12 when a force is applied to handles 18*c*. It should be understood that the nozzle tip may also be rotated by other methods, including for example, an actuator, such as an electric actuator or hydraulic actuator.

Figure 5:
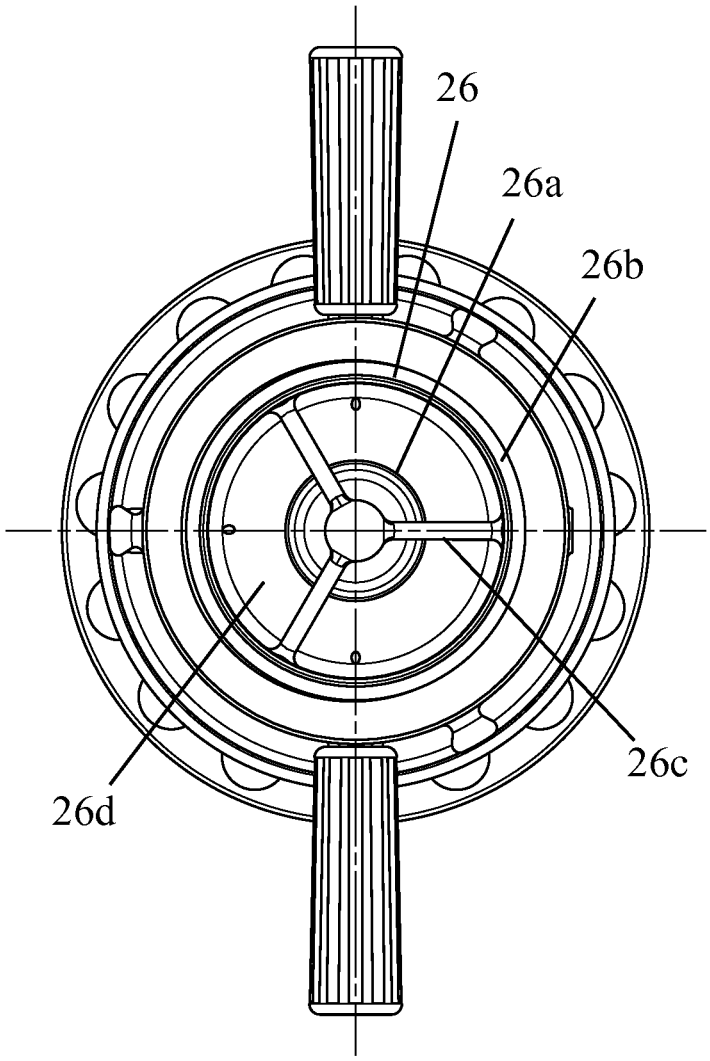
FIG. 5 is an input end elevation view of the nozzle assembly of FIG. 3.

Extending through inlet assembly 14 and nozzle body 12 is a passageway 22, which extends from inlet 16 to outlet 20 and further sealed by a plurality of o-ring seals S. Positioned in passageway 22 is a nozzle stem 24, which includes a base 26 that mounts nozzle stem 24 to nozzle body 12 in passageway 22. As best seen in FIGS. 4A and 5, base 26 includes an inner annular member 26*a* and an outer annular member 26*b*, which are interconnected by a plurality of radially extending ribs or arms 26*c*, which define there between a plurality of passageways 26*d* through which the water flows when inlet assembly 14 is mounted to and in fluid communication with a supply of fluid. As will be understood from FIG. 3, when fluid enters inlet 16, water will flow into passageway 22 and through one of the passageways 26*d* formed in base 26 and over the outer surface of stem 24 and flow between nozzle body 12 and the terminal end of stem 24 to exit at outlet 20. Stem 24 is movable in passageway 22 so that the pressure at the outlet can be adjusted by moving the stem to or away from outlet 20. In the illustrated embodiment, nozzle stem 24 has a cup-shaped base with a cone or bell shaped body 28 that extends from the cup-shaped base; however, it should be understood that the shape of the stem may vary depending on the application.

As noted above, in the illustrated embodiment nozzle assembly 10 comprises an automatic nozzle and is configured so that when there is a pressure drop in the incoming fluid at inlet 16, the position of the nozzle stem will automatically be adjusted to increase the pressure at outlet 20, though the volume of fluid will be decreased. To that end, nozzle assembly 10 includes a piston assembly 30, which mounts stem 24 to inner annular member 26*a* of base 26. Piston assembly 30 includes a piston 30*a* mounted to a rod 30*b*, which extends through valve stem 24 and secures valve stem 24 to base 26. Further, rod 30*b* extends through a tubular member 30*c* about which a compression spring 30*d*, such as a stainless steel compression spring, is mounted and further is captured between piston 30*a* (spacer spring 30*e* may be provided between spring and piston 30*a*) and cup-shaped end of stem 24. In this manner, when the pressure on stem 24 drops, compression spring 30d will urge stem 24 toward the direction of the inlet to thereby reduce the spacing between the cup-shaped body of stem 24 and the angled surface of the nozzle body to increase the pressure at the outlet.

In the illustrated embodiment, nozzle extension 32 is mounted to piston 30*a;* however, nozzle extension 32 may also be mounted to the stem. Nozzle extension 32 is mounted such that it extends and projects outwardly from nozzle assembly 10 and from outlet 20. In the illustrated embodiment, nozzle extension 32 comprises a solid body, such as solid metal or plastic body, with a tapered outer surface 32*a* that tapers from at or near the base 32*b* of the elongate body to at or near its distal end 32*c* to provide a flow surface for the fluid flowing form outlet 20 of nozzle assembly 10. Further, as note above, extension 32 at least partially and optionally substantially fills the void downstream of the piston and the stem.

In the illustrated embodiment, nozzle extension 32 comprises an elongate solid body with a concave tapered surface 32*a*. As noted above, nozzle extension 32 at least partially fills the void area just beyond the nozzle outlet where water exits nozzle assembly 10. By at least partially filling in this void area, the affect of the vacuum is lessened. Further, nozzle extension 32 may provide a flow surface where the natural surface tension of the water can be harnessed to converge the water stream in a less aggressive manner than heretofore known. Together, these to effects create a less destructive stream, better stream reach, and improved water deliver footprint of the target. It should be understood that the width, length, and shape of the extension may vary depending on the size of the nozzle. Further, as noted below, the flow surface may be concave, convex, or a combination of both. In addition, as will be more fully described in reference to a later embodiment, the nozzle extension may be hollowed and, further, may be formed from a pliable material.

Figure 8:
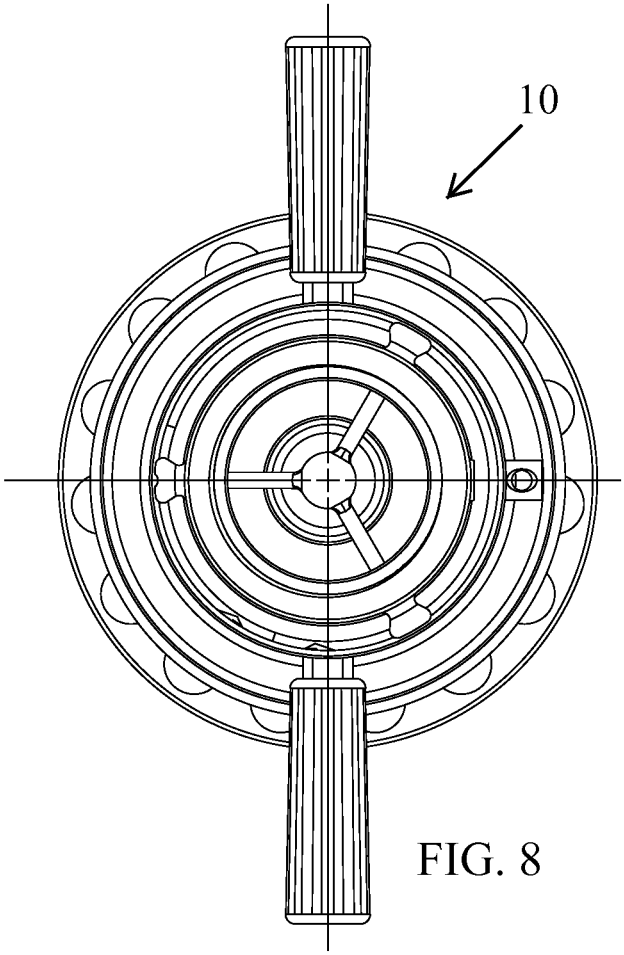
FIG. 8 is an inlet end elevation view of the nozzle assembly of FIG. 7.
Figure 6:
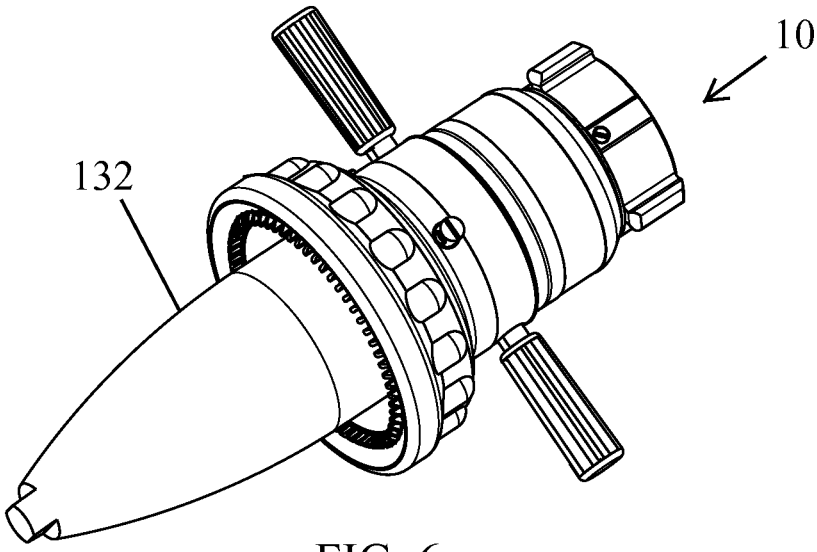
FIG. 6 is a perspective view of the nozzle assembly incorporating another embodiment of the nozzle stem extension.
Figure 7:
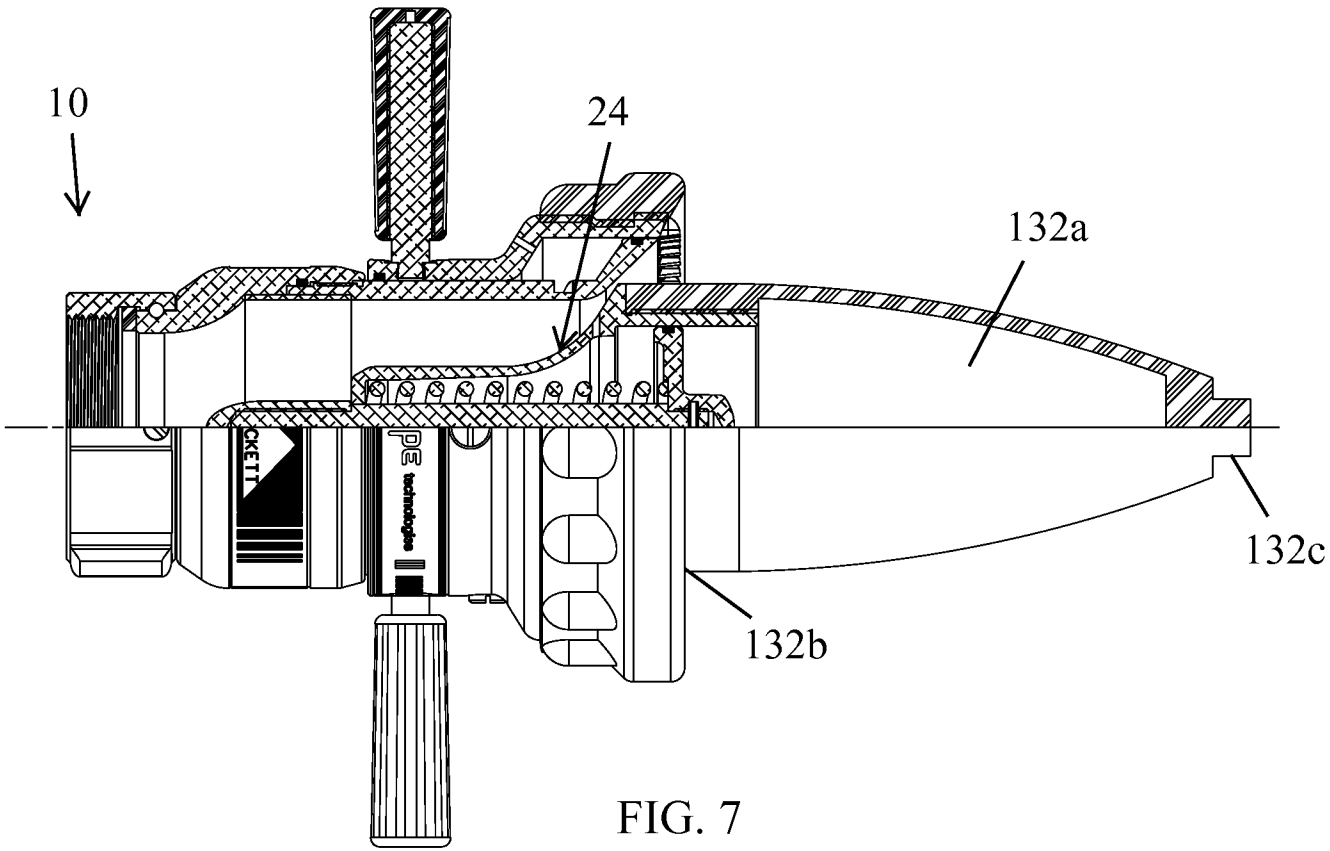
FIG. 7 is a cross-section view of the nozzle assembly of FIG. 6.

Referring to FIGS. 6-8, the numeral 132 generally designates another embodiment of the nozzle extension of the present invention. Nozzle extension 132 mounts to piston 30 of nozzle assembly 10 in a similar manner to the previous embodiment but instead includes a concave flow surface 132*a*, which extends with a varying cross-section that tapers from the base 132*b* to the distal end 132*c*.

Figure 9:
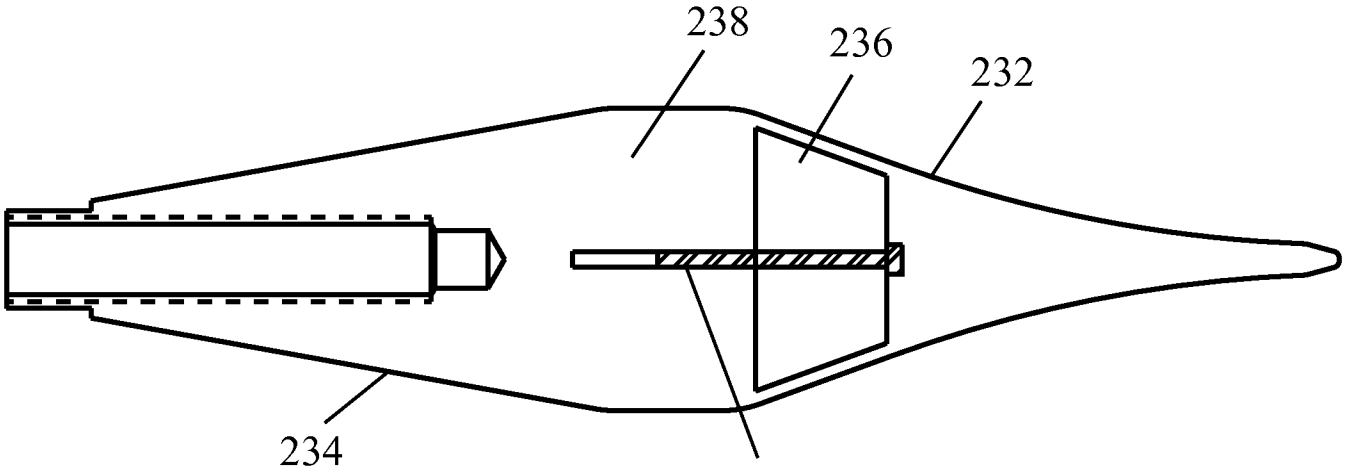
FIG. 9 is a cross-section view of another embodiment of the nozzle stem extension of the present invention.
Figure 10:
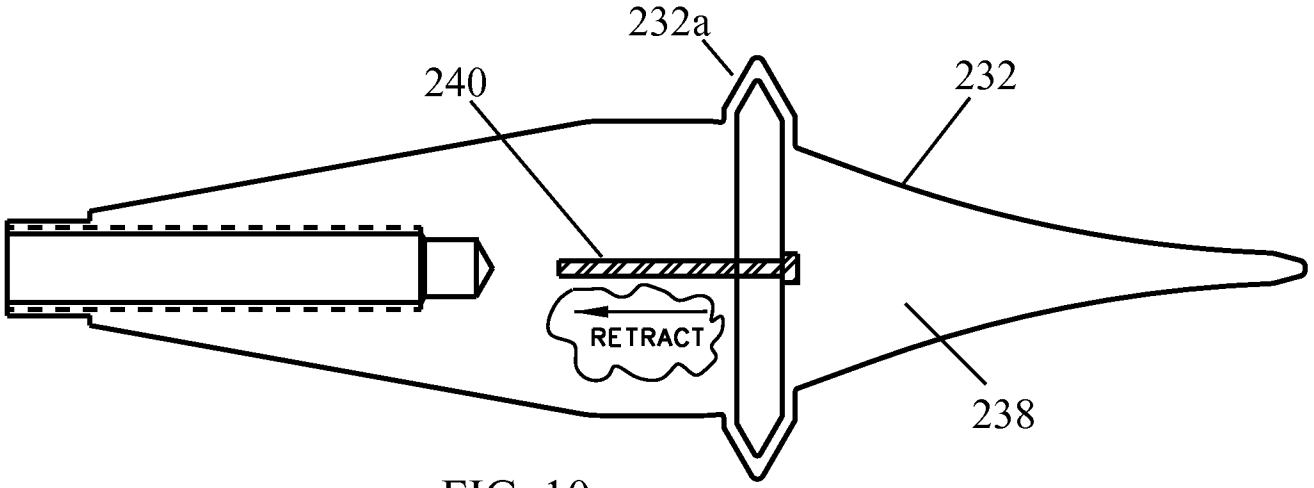
FIG. 10 is a similar view to FIG. 9 illustrating the change in cross-section of nozzle stem extension of the present invention.

Referring to FIGS. 9 and 10, the numeral 232 designates another embodiment of the nozzle extension of the present invention. Nozzle extension 232 similarly mounts to, for example, the piston 30 or stem 24 of nozzle assembly 10 in a similar manner to the previous embodiment and is formed from a hollowed body 234 and optionally from a pliable material so that the cross-section of extension 232 may be varied. Again, it should be understood that nozzle assembly 10 is for illustrative purposes and that extension 232, similar to the other extensions, may be mounted on different types of nozzles, examples of which are noted above.

In the illustrated embodiment, the cross-section of the nozzle extension 232 is hollowed to form a cavity 236 and further varied by a movable member 240, which selectively compresses the nozzle extension body at the hollowed portion of the body, which results in the outer surface of the nozzle extension body bulging to form an abutment 232*a* (FIG. 10). The degree of bulge or size of the abutment is a function of the size of the cavity and the pliability of the material forming the nozzle extension. For example, as shown, the movable member may comprise a rod with one end anchored to the tip end of the nozzle extension body and the other end extended into a passageway formed on the other side of the cavity and coupled to an actuator, such as a mechanical, electrical, electromechanical or hydraulic actuator or the like.

In this manner, the nozzle extension may be configured to form a local area of enlarged diameter, which as noted may be used to create an abutment against which the fluid flowing from outlet 20 impinges to produce a fog pattern or protective bubble, for example. In this manner, the nozzle extension may allow for the creation of a protective fog pattern. Further, this method allows for the creation of a protective fog pattern using all the water available as opposed to "stripping" away a portion of the water stream with fingers or other devices that intrude into the water stream (i.e. when all the water is diverted to the protective fog pattern, it is a more effect protective feature). In addition, the extension allows the creation of a protective fog pattern in "non-combination nozzles".

In any of the above embodiments of the body of the nozzle extension, the body may have a smooth outer surface or may a textured outer surface to further enhance the effect of filling the void beyond the outlet. For example, at least a portion or the whole outer surface may have dimples or grooves, such as longitudinal grooves that extend along the length of the extension or lateral or circumferential grooves. Further the outer surface may have regions of texture. Depending on the number and shape of the grooves or dimples, the flow over the body may be further dispersed or focused. For non-liquid flow through the nozzle, for example, fluidized powder flow, the textured surface may form pockets of air, which form a cushion to minimize or prevent the non-liquid material clumping on or sticking to the extension. In addition, the texture may be regular or irregular, or a combination of both. In the flexible or expandable version of the nozzle extension, it should be understood that when the body is expanded, the surface texture may change. For example, if longitudinal grooves are provided on the outer surface and the body is expanded, so too would the width of the groove. Similarly dimples may expand when the body is expanded. By expanding the size of the groove or dimple, the effects of the texture may be changed to enhance the dispersion or the focus of the fluid flow.

It should be understood that the components forming nozzle assembly 10, with the exception of the bumper, the handle grips, and o-ring seals and where otherwise noted, are generally formed from metal and typically brass or aluminum.

Accordingly, the present invention provides a nozzle assembly that can harness the natural surface tension of the water to converge the water stream in a less aggressive manner than heretofore known.

While several forms of the invention have been shown and described, it should be understood that modifications and changes may be made without departing from the scope of the invention. For example, as noted above, all though the present invention is described in reference to an automatic nozzle assembly, the nozzle may comprise one of several nozzle assemblies including, for example a combination nozzle, a smooth bore or solid stream nozzle, for example. Further, while several shapes of the nozzle extension have been shown and described, it should be understood that the shape may be varied as needed to achieve the desired affect.

We claim:

1. A fire fighting nozzle comprising:

a nozzle body with a proximal inlet, a distal outlet, and a passageway extending from the inlet to the outlet, the outlet defining an annular water flow pattern defining a void area therewithin;

a stem located in the passageway about which fluid flows when fluid is flowing through the passageway; and a projecting body comprising a base mounted to said fire fighting nozzle proximate said distal outlet and a distal end downstream of said base, such that said projecting body projects distally outwardly from the nozzle body away from the stem, the projecting body contained within the void area and at least partially filling the space beyond the nozzle outlet where water exits the nozzle assembly such that a vacuum created within the space beyond the nozzle outlet when a water stream exits the nozzle has a reduced effect on the water stream, the projecting body comprising a tapered outer surface in which a cross-sectional area of said projecting body does not increase from said base of said projecting body to said distal end of said projecting body, whereby said cross-sectional area is greater at said base than at said distal end.

2. The fire fighting nozzle according to claim 1, wherein the projecting body has a concave or convex outer flow surface.

3. The fire fighting nozzle according to claim 1, wherein the projecting body has a hollowed portion.

4. The fire fighting nozzle according to claim 3, wherein the projecting body is formed from a pliable material wherein the shape of the outer surface of the projecting body may be adjusted.

5. The fire fighting nozzle according to claim 4, wherein the projecting body is expandable and, when expanded forms an enlargement that projects outwardly from the projecting body.

6. The fire fighting nozzle according to claim 5, wherein the enlargement forms an abutment against which the water exiting the nozzle body outlet impinges.

7. The fire fighting nozzle according to claim 4, further comprising a moveable member, said hollowed portion forming a tapered cavity, and said moveable member supported in said cavity and adapted to move in said cavity to compress against said projecting body to thereby expand said projecting body and increase the cross-section of said projecting body to form an enlargement in said projecting body.

8. The fire fighting nozzle according to claim 7, further comprising a rod supporting said movable member in said cavity and adapted to couple to an actuator to thereby move the movable member in said cavity.

9. The fire fighting nozzle according to claim 1, further comprising a piston assembly, said piston assembly mounting said stem in said nozzle body, said piston assembly urging said stem toward said inlet when the pressure on said stem drops to thereby form an automatic nozzle.

10. The fire fighting nozzle according to claim 9, wherein said projecting body is mounted to said piston assembly.

11. The fire fighting nozzle according to claim 1, wherein said projecting body is mounted to said stem.

12. The fire fighting nozzle according to claim 1, wherein said projecting body comprises a solid body.

13. The fire fighting nozzle according to claim 12, wherein said tapered outer surface comprises a concave tapered outer surface or a convex tapered outer surface.

14. The fire fighting nozzle according to claim 1, wherein said projecting body has an outer surface, and at least a portion of said outer surface being textured.

15. A fire fighting nozzle comprising:

a nozzle body with an inlet, an outlet, and a passageway extending from the inlet to the outlet, said nozzle body comprising an annular member that is axially movable relative to said inlet;

a stem located in the passageway about which fluid flows when fluid is flowing through the passageway, said stem mounted for linear movement in said passageway;

a piston assembly mounting said stem to said nozzle body and adapted to move said stem in response to pressure in said passageway; and a projecting body projecting outwardly from the nozzle body away from the stem, said projecting body fixed relative to said inlet, said body mounted to said piston or said stem, and said projecting body at least partially filling the space beyond the nozzle outlet where water exits the nozzle assembly, and said projecting body having a tapered outer surface from a base of said projecting body to a distal end of said projecting body to form a fluid flow surface outwardly from said outlet.

16. The fire fighting nozzle according to claim 15, wherein said projecting body has at least a hollowed portion.

17. A fire fighting nozzle comprising:

a nozzle body with an inlet, an outlet, and a passageway extending from the inlet to the outlet;

a stem located in the passageway about which fluid flows when fluid is flowing through the passageway;

a projecting body projecting outwardly from the nozzle body away from the stem, the projecting body at least partially filling the space beyond the nozzle outlet where water exits the nozzle assembly, wherein the projecting body has a hollowed portion and wherein the projecting body is formed from a pliable material wherein the shape of the outer surface of the projecting body may be adjusted.

18. The fire fighting nozzle according to claim 17, wherein the projecting body is expandable and, when expanded forms an enlargement that projects outwardly from the projecting body.

19. The fire fighting nozzle according to claim 18, wherein the enlargement forms an abutment against which the water exiting the nozzle body outlet impinges.

20. The fire fighting nozzle according to claim 17, further comprising a moveable member, said hollowed portion forming a tapered cavity, and said moveable member supported in said cavity and adapted to move in said cavity to compress against said projecting body to thereby expand said projecting body and increase the cross-section of said projecting body to form an enlargement in said projecting body.

21. The fire fighting nozzle according to claim 20, further comprising a rod supporting said movable member in said cavity and adapted to couple to an actuator to thereby move the movable member in said cavity.

22. A fire fighting nozzle comprising:

a nozzle body with an inlet, an outlet, and a passageway extending from the inlet to the outlet, said nozzle body comprising an annular member that is axially movable relative to said inlet;

a stem located in the passageway about which fluid flows when fluid is flowing through the passageway;

a projecting body having a substantially convex outer flow surface projecting outwardly from the nozzle body away from the stem, the projecting body at least partially filling the space beyond the nozzle outlet where water exits the nozzle assembly and being fixed relative to said inlet;

a piston assembly, said piston assembly mounting said stem in said nozzle body, said piston assembly urging said stem toward said inlet when the pressure on said stem drops to thereby form an automatic nozzle.

23. The fire fighting nozzle according to claim 22, wherein said projecting body is mounted to said piston assembly.

24. The fire fighting nozzle according to claim 1, wherein said projecting body further comprises a convex outer flow surface.

25. The fire fighting nozzle according to claim 15, wherein said projecting body further comprises a convex outer flow surface.

26. The fire fighting nozzle according to claim 17, wherein said projecting body further comprises a convex outer flow surface.

* * * * *